US005813879A

United States Patent [19]

Russo

[11] Patent Number: 5,813,879

[45] Date of Patent: Sep. 29, 1998

[54] ELECTRIC CORD ACCESSORY

[76] Inventor: Danilo Russo, 30 Duanest, Farmingdale, N.Y. 11735

[21] Appl. No.: 916,314

[22] Filed: Aug. 22, 1997

[51] Int. Cl.[6] ..... H01R 13/62

[52] U.S. Cl. ..... 439/367

[58] Field of Search ..... 439/367–370, 439/180, 476, 484, 521

[56] References Cited

U.S. PATENT DOCUMENTS

| | | | |
|---|---|---|---|
| 4,784,612 | 11/1988 | Ryan | 439/367 |
| 4,940,424 | 7/1990 | Odbert | 439/367 X |
| 4,998,891 | 3/1991 | Bresko | 439/369 |
| 5,306,176 | 4/1994 | Coffey | 439/367 |

*Primary Examiner*—Khiem Nguyen

[57] ABSTRACT

The present invention relates to an accessory which is adapted to be fitted onto the male and female elements of an electrical cord. The accessory has four parts: an upper and lower half of a female housing and an upper and lower half of a male housing. The upper and lower halves of the female housing are adapted to be secured over the female portion of an electrical cord. Likewise, the upper and lower halves of the male housing are adapted to be secured over the male portion of an electrical cord. Each of the halves is secured to its corresponding half by way of arcuate protrusions along its periphery. Furthermore, each of the parts carries either a protrusion or a receptacle which is adapted to be secured to a mating element on the opposing housing.

5 Claims, 2 Drawing Sheets

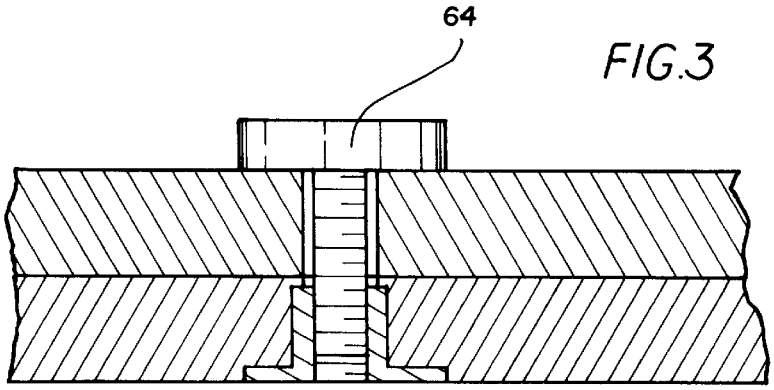
FIG.3
FIG.4
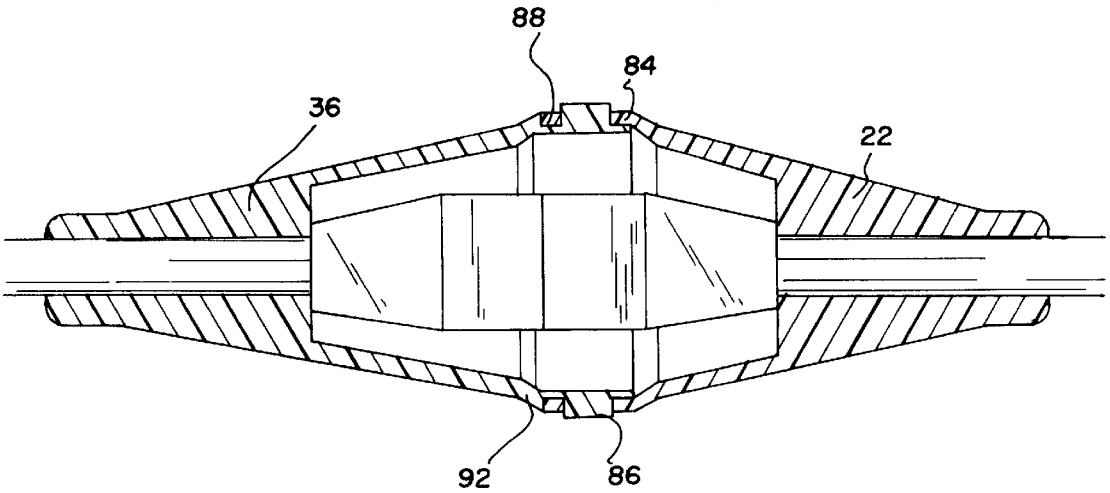

ELECTRIC CORD ACCESSORY

BACKGROUND OF THE INVENTION

1. Field of the Invention

The present invention relates to an electrical cord accessory and more particularly pertains to such an accessory which prevents the accidental uncoupling of the male and female portions of an electrical cord.

2. Description of the Prior Art

The use of electrical plug accessories is known in the prior art. More specifically, electrical plug accessories are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,940,424 to Odbert discloses an electrical plug accessory. U.S. Pat. No. 4,998,891 to Bresko discloses a holder for maintaining electrical connections. U.S. Design Pat. No. 346,787 to Cullen discloses the design of a lock for holding a power cord to an extension cord. U.S. Pat. No. 4,784,612 to Ryan discloses an electric plug holder. U.S. Pat. No. 4,723,822 to Merdic discloses a safety utility extension cord. Lastly, U.S. Pat. No. 4,940,423 to Aihara discloses a connector apparatus.

In this respect, the electrical cord accessory of the present invention substantially departs from the conventional concepts and designs of the prior art, and in so doing provides an apparatus primarily developed for the purpose of preventing the male and female portions of an electrical cord from becoming uncoupled.

Therefore, it can be appreciated that there exists a continuing need for improved plug accessories. In this regard, the present invention substantially fulfills this need.

SUMMARY OF THE INVENTION

In view of the foregoing disadvantages inherent in the known types of plug accessories now present in the prior art, the present invention provides an accessory in four parts adapted to fit over most electric cords. As such, the general purpose of the present invention, which will be described subsequently in greater detail, is to provide an electric cord accessory with arcuate flange securing means.

To attain this, the present invention essentially comprises an accessory which is adapted to be fitted onto the male and female elements of an electrical cord. The accessory has four parts: an upper and lower half of a female housing and an upper and lower half of a male housing. The upper and lower halves of the female housing are adapted to be secured over the female portion of an electrical cord. Likewise, the upper and lower halves of the male housing are adapted to be secured over the male portion of an electrical cord. Each of the haves is secured to its corresponding half by way of arcuate protrusions along its periphery. Furthermore, each of the parts carries either a protrusion or a receptacle which is adapted to be secured to a mating element on the opposing housing.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved electrical plug accessory which prevents the male and female portions of an electric cord from becoming disengaged. The accessory comprises a female housing assembly comprising an upper half and a lower half, and wherein each half has a rearward extent, a forward extent, a first side edge, a second side edge, an exterior surface and an interior surface. Each half is tapered from the forward toward the rearward extents. A male housing assembly is included which comprises an upper half and a lower half. Each half has a rearward extent, a forward extent, a first side edge, a second side edge, an exterior surface and an interior surface. Each half is tapered from the forward toward the rearward extent. An upper pair of primary arcuate flanges are secured to opposite sides of the upper half of the female housing at the forward extent. An upper pair of secondary arcuate flanges is secured to the opposite sides of the upper half of the female housing at the rearward extent. A lower pair of primary arcuate flanges are secured to opposite sides of the lower half of the female housing at the forward extent, and a lower pair of secondary arcuate flanges are secured to the opposite sides of the lower half of the female housing at the rearward extent. Screws are employed to secure the pair of upper primary flanges of the female housing to the pair of lower primary flanges of the female housing. Additionally, screws are used to secure the pair of upper secondary flanges of the female housing to the pair of lower secondary flanges of the female housing. An upper pair of primary arcuate flanges are secured to opposite sides of the upper half of the male housing at the forward extent, and an upper pair of secondary arcuate flanges are secured to the opposite sides of the upper half of the male housing at the rearward extent. A lower pair of primary arcuate flanges are secured to opposite sides of the lower half of the male housing at the forward extent, and a lower pair of secondary arcuate flanges are secured to the opposite sides of the lower half of the male housing at the rearward extent. Screws are employed in securing the pair of upper primary flanges of the male housing to the pair of lower primary flanges of the male housing, and screws secure the pair of upper secondary flanges of the male housing to the pair of lower secondary flanges of the male housing. An upper receptacle is secured to the upper half of the female housing at the forward extent, and a lower receptacle is secured to the lower half of the female housing at the forward extent. An upper protrusion is secured to the upper half of the male housing at the forward extent, and a lower protrusion is secured to the lower half of the male housing at the forward extent.

It is another object of the present invention to provide a an accessory which can be readily retro fitted, in a secure manner, to most electrical cords.

It is a further object of the present invention to provide an electrical cord accessory with protrusions and receptacles which ensure a secure fit between the female and male housing components.

An even further object of the present invention is to provide an electrical cord accessory which is susceptible of a low cost of manufacture with regard to both materials and labor, and which accordingly is then susceptible of low prices of sale to the consuming public, thereby making such electrical cord accessories economically available to the buying public.

Still yet another object of the present invention is to provide an electrical cord accessory which provides in the apparatuses and methods of the prior art some of the advantages thereof, while simultaneously overcoming some of the disadvantages normally associated therewith.

Still another object of the present invention is to provide an electrical accessory of durable construction.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a view taken along line 3—3 of FIG. 1.

FIG. 4 is a view taken along line 4—4 of FIG. 1.

Similar reference characters refer to similar parts throughout the several views of the drawings.

DESCRIPTION OF THE PREFERRED EMBODIMENT

Figure 1:
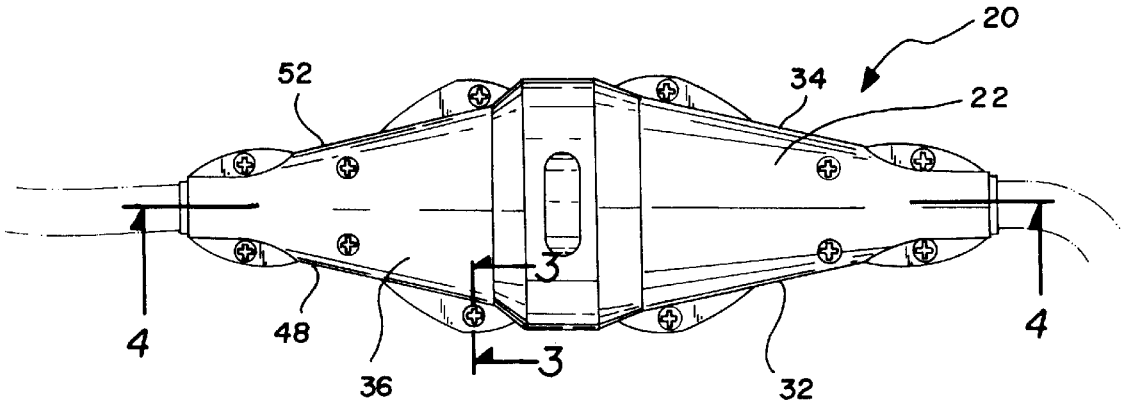
FIG. 1 is a top plan view of the male and female housings in use.
Figure 2:
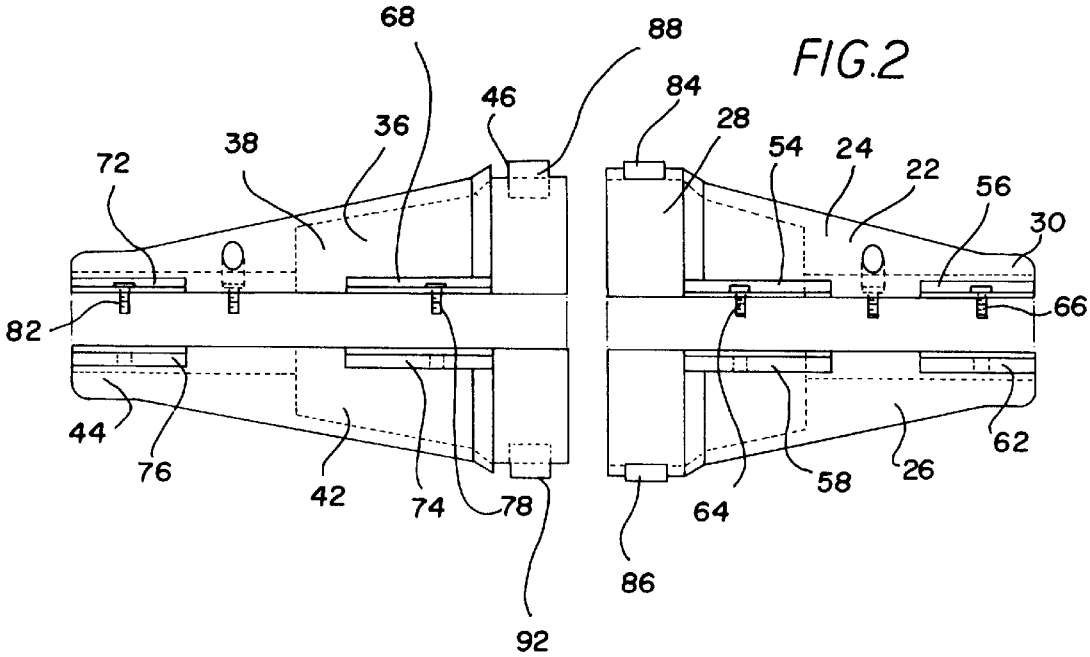
FIG. 2 an exploded view of the upper and lower halves of both the male and female housings.

The present invention relates to an accessory which is adapted to be fitted onto the male and female elements of an electrical cord. The accessory has four parts: an upper and lower half of a female housing and an upper and lower half of a male housing. The upper and lower halves of the female housing are adapted to be secured over the female portion of an electrical cord. Likewise, the upper and lower halves of the male housing are adapted to be secured over the male portion of an electrical cord. Each of the haves is secured to its corresponding half by way of arcuate protrusions along its periphery. Furthermore, each of the parts carries either a protrusion or a receptacle which is adapted to be secured to a mating element on the opposing housing. The various components of the present invention, and the manner in which they interrelate, will be described in greater detail hereinafter.

The female housing assembly 22 comprises two parts an upper half 24 and a lower half 26. Each of these halves includes a rearward extent 30, a forward extent 28, a first side edge 32, a second side edge 34, an exterior surface and an interior surface. Additionally, in the preferred embodiment, each half is tapered from its forward 28 toward its rearward 30 extent.

Likewise, the male housing assembly 36 comprises two parts, an upper half 38 and a lower half 42. Each half has a rearward extent 44, a forward extent 46, a first side edge 48, a second side edge 52, an exterior surface and an interior surface. Also, each half is tapered from its forward 46 toward its rearward 44 extent.

An upper pair of primary arcuate flanges 54 are each secured to opposite sides of the upper half 24 of the female housing at the forward extent 28. These upper pair of primary flanges 54 are depicted in FIG. 1. Additionally, an upper pair of secondary arcuate flanges 56 are secured to the opposite sides of the upper half 24 of the female housing 22 at the rearward extent 30. Additionally, a lower pair of primary arcuate flanges 58 are secured to opposite sides of the lower half 26 of the female housing 22 at the forward extent 28. A lower pair of secondary arcuate flanges 62 are secured to the opposite sides of the lower half 26 of the female housing 22 at the rearward extent 30.

Screws 64, in the preferred embodiment, are employed to secure the pair of upper primary flanges 54 of the female housing 22 to the pair of lower primary flanges 58 of the female housing. These screws are depicted in FIG. 1. Furthermore, screws 66 are used in securing the pair of upper secondary flanges 56 of the female housing to the pair of lower secondary flanges 62 of the female housing. In this manner the upper and lower halves of the female housing 22 are secured over the female component of an electrical cord. In order to remove the female housing, the screws are simply removed and the upper and lower halves removed.

Turning now to the male housing 36 depicted in FIG. 1. An upper pair of primary arcuate flanges 68 are secured to opposite sides of the upper half 38 of the male housing 36 at the forward extent 46. Additionally, an upper pair of secondary arcuate flanges 72 are secured to the opposite sides of the upper half 38 of the male housing 36 at the rearward extent 44. Furthermore, a lower pair of primary arcuate flanges 74 are secured to the opposite sides of the lower half 42 of the male housing 36 at the forward extent 46, and a lower pair of secondary arcuate flanges 76 are secured to the opposite sides of the lower half 42 of the male 36 housing at the rearward extent 44.

As with the female housing, screws 78 are adapted to secure the pair of upper primary flanges 68 of the male housing 36 to the pair of lower primary flanges 74 of the male housing 36. Additionally, screws 82 secure the pair of upper secondary flanges 72 of the male housing 36 to the pair of lower secondary flanges 76 of the male housing 36. In each instance one screw is employed to secure an upper to a lower flange. Thus, the male housing 36 is secured over the male component of an electrical cord by placing the upper 38 and lower 42 halves in mating relationship with the respective flanges in contact. Thereafter, screws are employed to secure the respective flanges together.

Once the housings are installed on the electrical cords a set of receptacles and protrusions are employed to insure that the two housings, once coupled, are not easily uncoupled. Specifically, an upper receptacle 84 is secured to the upper half 24 of the female housing 22 at the forward extent 28. Additionally, a lower receptacle 86 is secured to the lower half 26 of the female housing 22 at the forward extent 28. Likewise, an upper protrusion 88 is secured to the upper half 38 of the male housing 36 at the forward extent 46, and a lower protrusion 92 is secured to the lower half 42 of the male housing 36 at the forward extent 46. These protrusions and receptacles are illustrated in reference to FIGS. 1 and 4. Thus, with the housings secured over an electrical cord, the female housing can be brought into engagement with the male housing. In addition the male and female portions of the electrical cord coming into engagement, the protrusions of the male housing will engage the receptacles of the female housing. The engagement between the protrusions and receptacles is an interference fit requiring a substantial force before they become uncoupled. In this manner the accidental uncoupling of the male and female portions of the electrical cord is prevented.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by letters patent of the United States is as follows:

1. An electrical plug accessory which prevents the male and female portions of an electric cord from becoming disengaged, the accessory comprising in combination:

a female housing assembly comprising an upper half and a lower half, each half having a rearward extent, a forward extent, a first side edge, a second side edge, an exterior surface and an interior surface, each half being tapered from the forward toward the rearward extent;

a male housing assembly comprising an upper half and a lower half, each half having a rearward extent, a forward extent, a first side edge, a second side edge, an exterior surface and an interior surface, each half being tapered from the forward toward the rearward extent;

an upper pair of primary arcuate flanges secured to opposite sides of the upper half of the female housing at the forward extent, an upper pair of secondary arcuate flanges secured to the opposite sides of the upper half of the female housing at the rearward extent;

a lower pair of primary arcuate flanges secured to opposite sides of the lower half of the female housing at the forward extent, a lower pair of secondary arcuate flanges secured to the opposite sides of the lower half of the female housing at the rearward extent;

screws securing the pair of upper primary flanges of the female housing to the pair of lower primary flanges of the female housing, and screws securing the pair of upper secondary flanges of the female housing to the pair of lower secondary flanges of the female housing;

an upper pair of primary arcuate flanges secured to opposite sides of the upper half of the male housing at the forward extent, an upper pair of secondary arcuate flanges secured to the opposite sides of the upper half of the male housing at the rearward extent;

a lower pair of primary arcuate flanges secured to opposite sides of the lower half of the male housing at the forward extent, a lower pair of secondary arcuate flanges secured to the opposite sides of the lower half of the male housing at the rearward extent;

screws securing the pair of upper primary flanges of the male housing to the pair of lower primary flanges of the male housing, and screws securing the pair of upper secondary flanges of the male housing to the pair of lower secondary flanges of the male housing;

an upper receptacle secured to the upper half of the female housing at the forward extent, a lower receptacle secured to the lower half of the female housing at the forward extent;

an upper protrusion secured to the upper half of the male housing at the forward extent, a lower protrusion secured to the lower half of the male housing at the forward extent.

2. An electrical plug accessory which prevents the male and female portions of an electric cord from becoming disengaged, the accessory comprising in combination:

a female housing assembly comprising an upper half and a lower half, each half having a rearward extent, a forward extent, a first side edge, a second side edge, an exterior surface and an interior surface;

a male housing assembly comprising an upper half and a lower half, each half having a rearward extent, a forward extent, a first side edge, a second side edge, an exterior surface and an interior surface;

an upper pair of primary flanges secured to opposite sides of the upper half of the female housing at the forward extent, an upper pair of secondary flanges secured to the opposite sides of the upper half of the female housing at the rearward extent;

a lower pair of primary flanges secured to opposite sides of the lower half of the female housing at the forward extent, a lower pair of secondary flanges secured to the opposite sides of the lower half of the female housing at the rearward extent;

screws securing the pair of upper primary flanges of the female housing to the pair of lower primary flanges of the female housing, and screws securing the pair of upper secondary flanges of the female housing to the pair of lower secondary flanges of the female housing;

an upper pair of primary flanges secured to opposite sides of the upper half of the male housing at the forward extent, an upper pair of secondary flanges secured to the opposite sides of the upper half of the male housing at the rearward extent;

a lower pair of primary flanges secured to opposite sides of the lower half of the male housing at the forward extent, a lower pair of secondary flanges secured to the opposite sides of the lower half of the male housing at the rearward extent;

screws securing the pair of upper primary flanges of the male housing to the pair of lower primary flanges of the male housing, and screws securing the pair of upper secondary flanges of the male housing to the pair of lower secondary flanges of the male housing.

3. The accessory as described in claim 2 wherein:

each half of the male housing is tapered from the forward toward the rearward extent; and each half of the female housing is tapered from the forward toward the rearward extent.

4. The accessory as described in claim 2 further comprising:

an upper receptacle secured to the upper half of the female housing at the forward extent, a lower receptacle secured to the lower half of the female housing at the forward extent; and an upper protrusion secured to the upper half of the male housing at the forward extent, a lower protrusion secured to the lower half of the male housing at the forward extent.

5. The accessory as described in claim 2 wherein:

the flanges of the upper and lower halves of the female housing are arcuate in shape; and the flanges of the upper and lower halves of the male housing are arcuate in shape.

* * * * *